US007846301B2

(12) United States Patent
Katou et al.

(10) Patent No.: US 7,846,301 B2
(45) Date of Patent: Dec. 7, 2010

(54) METHOD OF PRODUCTION OF BLAST FURNACE COKE

(75) Inventors: Kenji Katou, Futtu (JP); Isao Sugiyama, Muroran (JP); Yoshiaki Nakashima, Oita (JP); Hiroshi Uematsu, Tokyo (JP); Takashi Arima, Futtsu (JP); Masahiko Yokomizo, Futtsu (JP); Michitaka Sakaida, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 526 days.

(21) Appl. No.: 11/884,184

(22) PCT Filed: May 12, 2006

(86) PCT No.: PCT/JP2006/309981

§ 371 (c)(1),
(2), (4) Date: Aug. 9, 2007

(87) PCT Pub. No.: WO2006/121213

PCT Pub. Date: Nov. 16, 2006

(65) Prior Publication Data

US 2008/0190753 A1 Aug. 14, 2008

(30) Foreign Application Priority Data

May 13, 2005 (JP) ..... 2005-141524

(51) Int. Cl.
*C10B 53/00* (2006.01)

(52) U.S. Cl. ..... 201/6; 201/8; 201/24; 44/591; 44/599; 264/125; 264/126

(58) Field of Classification Search ..... 201/6, 201/8, 21, 24; 44/591, 599; 264/125, 126
See application file for complete search history.

(56) References Cited

U.S. PATENT DOCUMENTS

| | | | | | |
|---|---|---|---|---|---|
| 3,546,076 | A | * | 12/1970 | Muller et al. | 201/6 |
| 4,142,941 | A | * | 3/1979 | Weber et al. | 201/6 |
| 4,221,570 | A | * | 9/1980 | Wasson | 44/551 |
| 6,033,528 | A | * | 3/2000 | Sakawa et al. | 201/1 |
| 7,497,928 | B2 | * | 3/2009 | Clark | 201/6 |
| 7,645,362 | B2 | * | 1/2010 | Kato et al. | 201/1 |

FOREIGN PATENT DOCUMENTS

GB 1 545 255 5/1979

(Continued)

OTHER PUBLICATIONS

Coal Processing & Comprehensive Utilization, No. 6, 2001.

(Continued)

*Primary Examiner*—N. Bhat
(74) *Attorney, Agent, or Firm*—Kenyon & Kenyon LLP

(57) ABSTRACT

A method of production of blast furnace coke comprising drying mixed coal, then, or simultaneously with the drying, classifying it to fine-grained coal and coarse-grained coal, then adding to the fine-grained coal at a temperature of 80 to 350° C. a caking additive comprised of one or more of a heavy distillate of tar, soft pitch, and petroleum pitch, agglomerating it by hot pressing, then mixing the clumps of coal and the coarse-grained coal and charging and carbonizing the mixture in a coke oven.

11 Claims, 4 Drawing Sheets

FOREIGN PATENT DOCUMENTS

| | | | |
|---|---|---|---|
| JP | 52-71504 | | 6/1977 |
| JP | 4-285690 | A | 10/1992 |
| JP | 4-332790 | A | 11/1992 |
| JP | 07-118665 | | 5/1995 |
| JP | 08-209150 | | 8/1996 |
| JP | 08239669 | A | 9/1996 |
| JP | 09-003458 | | 1/1997 |
| JP | 09003458 | A | 1/1997 |
| JP | 09-048977 | | 2/1997 |
| JP | 09241655 | A | 9/1997 |
| JP | 10-183136 | A | 7/1998 |
| JP | 2005213461 | A | 8/2005 |

OTHER PUBLICATIONS

Chinese Office Action dated on Nov. 6, 2009, issued in corresponding Chinese Patent Application No. 2006800045561.

"Coke Notes", The Fuel Society of Japan 1988, p. 134.

Coal Utilization Technical Terminology Dictionary (Fuel Association of Japan ed., 1983), p. 255.

English Translation of: "Coke Notes", The Fuel Society of Japan 1988, p. 134.

English Translation of: "Coal Utilization Technical Terminology Dictionary" (Fuel Association of Japan ed., 1983), p. 255.

* cited by examiner

METHOD OF PRODUCTION OF BLAST FURNACE COKE

This application is a 371 of PCT/JP2006/309981, filed May 12, 2006, which claims priority to Japanese Patent Application No. 2005-141524, filed May 13, 2005.

TECHNICAL FIELD

The present invention relates to a method of production of metallurgical coke, more particularly relates to a method of producing blast furnace coke by drying coal, classifying it, then agglomerating the fine-grained coal, and carbonizing the briquettes and coarse-grained coal in a chamber type coke oven.

BACKGROUND ART

In the past, in the method of production of blast furnace coke, from the point of view of the increase of the charged bulk density and resultant improvement of coke strength and the shortening of the carbonization time and resultant improvement of coke productivity, the practice has been to dry the coking coal containing moisture of 8 to 12% or so to reduce the moisture content in the coking coal to 5 to 6% or so and further to 0%, then charging and carbonizing it in a coke oven.

For example, the precarbon method of drying the coking coal to a moisture content of 0% and preheating it to a peak temperature of 150 to 230° C. or so, then charging and carbonizing it in a coke oven is known (for example, see "Coke Notes", The Fuel Society of Japan 1988, pg. 134).

According to this method, the coke productivity is improved by approximately 35% compared to when not preheating coal. Further, the coke strength and other aspects of the quality of the coke are improved. Due to this, the ratio of the non- or slightly-caking coal or other poor quality coal with poor caking ability in the mixed coal can be increased to approximately 25%.

However, if drying or preheating the coking coal to reduce the moisture content in the coking coal to 5% or less or further to near 0%, the problem arises of the fine-grained coal easily producing dust in the process of transport of the coal and at the time of charging into the coke oven.

As prior art for solving this dust producing problem of fine-grained coal, the method has been proposed of drying and preheating the coal, then classifying it and forming only the fine-grained coal of 0.5 mm and 0.3 mm causing the dust production into masses.

For example, the method is known of drying and classifying the coking coal, kneading only the recovered fine-grained coal or the fine-grained coal in which part of the coarse-grained coal is added plus tar etc. to obtain pseudo particles and thereby suppressing the production of dust due to the fine-grained coal in the dry coal (for example, see Japanese Patent Publication (A) No. (A) 8-239669).

However, in this method, if the drying of the coking coal causes the moisture content in the coking coal to drop, the strength of the pseudo particles will drop due to the drop in the adhered moisture and they will crumble during transport, so it is not possible to dry the coal to reduce the moisture content in the coal too much. As a result, the effect of improvement of the coal bulk density in the coke oven and improvement of coke strength due to the drying of the coal could not be sufficiently obtained.

Further, a method of production of coke has been proposed of crushing the coal, drying and heating the mixed coal comprised of fine grains of 3 mm or less in an amount of 85 to 95% and the balance of coarse grains of 10 mm or less, adding and mixing 3 to 8% of tar to all of the mixed coal at a temperature of 140° C., rolling it at a temperature of 120° C. to obtain briquettes, and carbonizing them in a coke oven (for example, see Japanese Patent Publication (A) No. 52-71504).

Further, a method of production of coke has been proposed of drying coal to a moisture content of 0 to 2.7%, classifying it, adding tar in an amount of 3 to 5% to only the recovered fine-grained coal of 0.3 mm or less at a temperature of 80° C. or less, agglomerating the result by a grooved roll to form briquettes, and carbonizing the result together with the balance of the mixed coal, that is, the coarse-grained coal, in a coke oven (for example, see Japanese Patent Publication (A) No. 9-3458).

The briquettes obtained by these methods all are increased in strength of the masses compared with the above pseudo particles, so the masses can be kept from crumbling during transport. Further, by forming the coal into briquettes, the distance between fine powder particles in the coal becomes small, so the adhesion between fine powder particles at the time of carbonization of the briquettes in a coke oven rises and the coke strength is improved.

However, even by these methods, if the ratio of non- or slightly-caking coal with a low caking ability within the mixed coal is raised, it became difficult to sufficiently secure the strength of the coke even by the method of carbonizing the briquettes in the coke oven.

Further, when adding tar to the dried coal or preheated coal and agglomerating it by rolling, if agglomerating at a high temperature, the volatile ingredients within the tar form a gas, the pressure of the gas inside the rolled briquettes increases, the agglomerating becomes difficult, the briquettes cracks, and other problems arise causing a drop in productivity and product yield.

In particular, when classifying dried coal or preheated coal, then adding tar to only the fine-grained coal and rolling it, compared to when rolling mixed coal containing coarse-grained coal, the occurrence of cracks due to the coarse-grained coal in the briquettes at the time of agglomerating is suppressed, but the gas produced inside the briquettes at the time of agglomerating has a hard time escaping, so the above problem due to the increase in internal pressure in the briquettes becomes remarkable.

For these reasons, when adding tar to dried coal or preheated coal, in particular fine-grained coal, and agglomerating it by rolling, it was necessary to roll it in a state with the temperature of the fine-grained coal reduced to less than 80° C.

On the other hand, coking coal can be supplied stably and cheaply in terms of a resource, but it is required to manufacture coke of high strength cheaply and with high productivity when mixing a large amount of non- or slightly-caking coal or other poor quality coal with a low caking ability into the mixed coal.

By using the above coal drying or precarbon method, the bulk density at the time of charging the coal into the coke oven increases, so it is possible to secure a predetermined coke strength even when mixing in a certain large amount of non- or slightly-caking coal or other poor quality coal with a low caking ability.

However, with these methods, to secure a predetermined coke strength, the ratio of the non- or slightly-caking coal etc. with a low caking ability mixed in the mixed coal was limited to at most 25%.

As technology for solving this problem, in recent years, the method of production of coke has been proposed of modifying the entire of mixed coal containing the large amount of non- or slightly-caking coal or other poor quality coal with a low caking ability by rapidly heating until softening and melting at about 350° C. or more, higher than the heating temperature of the precarbon method, rolling the coal in the semi-molten state with the caking ability while maintaining the temperature at 350° C. or more to form briquettes, then carbonizing them in a coke oven (for example, see Japanese Patent Publication (A) No. 07-118665).

However, with the method of rapid heating the entire amount of dried and preheated mixed coal by an air flow tower, the differences in particle size between the fine-grained coal and the coarse-grained coal causes differences in the heating temperatures at the coal particles. In particular, the fine-grained coal loses its caking ingredients due to overheating and therefore the caking ability of the non- or slightly-caking coal cannot be sufficiently improved.

Therefore, to solve this problem, the method or production of blast furnace coke has been proposed of drying and preheating non- or slightly-caking coal mixed into the mixed coal in an amount of 10 to 60% at a temperature of 50 to 350° C., classifying it into fine-grained coal of a particle size of 0.3 mm or less and coarse-grained coal of a particle size of over 0.3 mm, rapidly heating said fine-grained coal to a temperature range of the softening start temperature to the maximum fluidity temperature at a rate of temperature increase of $1\times10^3$ to $1\times10^5$° C./minute, then hot agglomerating it at a pressure of 5 to 1,000 kg/cm$^2$ in the state held at that temperature range, then mixing in said coarse-grained coal of the non- or slightly-caking coal and carbonizing the mixture in a coke oven (for example, see Japanese Patent Publication (A) No. 08-209150 and Japanese Patent Publication (A) No. 09-048977).

However, there were the following problems when using these rapid heating methods for coal to rapidly heat the entire amount of non- or slightly-caking coal in the mixed coal or only the fine-grained coal from the softening start temperature of 350° C. or more to the maximum fluidity temperature and rolling the result in a semi-molten state while maintaining a high temperature of 350° C. or more.

That is, it becomes difficult to charge semi-molten state coal into a roll molding machine and becomes necessary to shape it while controlling the temperature so as to prevent the caking ingredients from escaping or being oxidized in a high temperature state.

Further, it has been known in the past that the fine-grained part after crushing coal contains a larger amount vitrinite ingredients and other caking ingredients compared to the coarse-grained part. Because of this, the amount of improvement of the caking ingredient of the fine-grained coal due to the rapid heating is smaller compared to the coarse-grained coal in the coal. Rather, when the fine-grained coal is heated to a high temperature state, the deterioration due to escape or oxidation of the caking ingredient when the fine-grained coal is heated to the high temperature state becomes larger than that of the coarse-grained coal.

Further, when using this method to rapidly heat and modify the non- or slightly-caking coal contained in a large amount in the mixed coal, it is necessary to separately heat treat the fine-grained coal and coarse-grained coal in the non- or slightly-caking coal by an air current tank etc., so the cost of the equipment is expensive and the operating conditions also become complicated.

Consequently, the conventional coal rapid heating method cannot be said to be sufficient as a method using mixed coal containing a large amount of non- or slightly-caking coal to produce high strength coke inexpensively while maintaining a high productivity.

DISCLOSURE OF THE INVENTION

An object of the present invention is to provide a method of production of blast furnace coke comprising drying and classifying mixed coal containing a large amount of inexpensive non- or slightly-caking coal or other poor quality coal with a low caking ability, then agglomerating the fine-grained coal to form briquettes and dry distilling the result together with the coarse-grained coal in a chamber type coke oven to produce high strength coke during which suppressing the dust production due to the fine-grained coal in the dried coal and improving the expansibility and other carbonization characteristics of the briquettes obtained by agglomerating the non- or slightly-caking coal or other poor quality coal with low caking ability so as to thereby enable production of high strength coke inexpensively at a high productivity.

The gist of the present invention is as follows:

(1) A method of production of blast furnace coke characterized by drying mixed coal, then, or simultaneously with the drying, classifying it into fine-grained coal and coarse-grained coal, then adding to the fine-grained coal at a temperature of 80 to 350° C. a caking additive comprised of one or more of a heavy distillate of tar, soft pitch, and petroleum pitch, agglomerating it by hot pressing, then mixing the clumps of coal and the coarse-grained coal and charging and carbonizing the mixture in a coke oven.

(2) A method of production of blast furnace coke as set forth in (1) characterized by adding the caking additive to fine-grained coal at a temperature of over 120° C. to 350° C. and agglomerating it by hot pressing.

(3) A method of production of blast furnace coke as set forth in (1) or (2) characterized in that said heavy distillate of tar contains an ingredient with a boiling point at ordinary pressure of 300° C. or more in an amount of 80 mass % or more.

(4) A method of production of blast furnace coke as set forth in any one of (1) to (3) characterized in that said heavy distillate is mainly comprised of one or more of phenanthrene, anthracene, methyl naphthalene, and fluoroanthene.

(5) A method of production of blast furnace coke as set forth in any one of (1) to (4) characterized in that said soft pitch has a softening point of 30 to 200° C.

(6) A method of production of blast furnace coke as set forth in any one of (1) to (5) characterized in that said petroleum pitch has a hydrogen/carbon atomic ratio of 0.9 or more and a softening point of 100 to 400° C.

(7) A method of production of blast furnace coke as set forth in any one of (1) to (6) characterized in that the amount of addition of said caking additive is 2 to 20 mass %.

(8) A method of production of blast furnace coke as set forth in any one of (1) to (7) characterized by agglomerating by hot pressing at a linear pressure of 0.5 to 10 t/cm.

(9) A method of production of blast furnace coke as set forth in any one of (1) to (8) characterized in that said mixed coal is comprised of non- or slightly-caking coal in an amount of 0 to 70 mass % and the balance of caking coal.

(10) A method of production of blast furnace coke as set forth in any of (1) to (9) characterized by classifying the coal to fine-grain of 0.5 mm or less and coarse-grained coal of over 0.5 mm.

(11) A method of production of blast furnace coke as set forth in any one of (1) to (10) characterized by classifying the coal to fine-grained coal and coarse-grained coal, then rapid heating the coarse-grained coal at a rate of temperature increase of 100 to 10,000° C./second to a peak temperature of 300 to 450° C., then charging and carbonizing said coarse-grained coal and said fine-grained coal in a coke oven.

According to the present invention, even when using mixed coal containing a large amount of inexpensive non- or slightly-caking coal or other poor quality coal with low caking ability, by drying and classifying the mixed coal, then adding to the recovered fine-grained coal at a temperature of 80 to 350° C. a caking additive comprised of one or more of a heavy distillate of tar, soft pitch, and petroleum pitch, and agglomerating it by hot pressing, it is possible to obtain briquettes with a high expansion rate at the time of carbonization by interaction between the vitrinite or other caking ingredients contained in a high concentration in the fine-grained coal and the caking additive with a high boiling point and softening point. By carbonizing these briquettes in a coke oven, it is possible to produce high strength coke inexpensively at a high productivity.

BEST MODE FOR CARRYING OUT THE INVENTION

First, the technical concept of the present invention will be described.

In the past, it has been known that the fine-grained coal with a particle size of about 0.5 mm or less obtained by crushing coal contains a large amount of vitrinite and other caking ingredients. This is believed to be because the vitrinite and other caking ingredients in coal are softer than the inert ingredients and other non-softening ingredients and are concentrated in the fine-grained coal since they easily separate at the time of crushing the coal. However, fine-grained coal containing a large amount of caking ingredients has a larger specific surface area in comparison to coarse grains, so in the high temperature state after drying and classifying the coal, the vitrinite and other caking ingredients in the fine-grained coal easily deteriorates in caking ability due to oxidation in the atmosphere.

By agglomerating the fine-grained coal containing a large amount of caking ingredients by a molding machine, there are the effects of reducing the specific surface area and suppressing the oxidation of the vitrinite and other caking ingredients due to the oxygen in the atmosphere and of reducing the distance between fine-grained particles and improving the expansion rate at the time of carbonization.

The present inventors took note of the fact that fine-grained coal contains vitrinite and other caking ingredients in a high concentration and studied the method of improving the coke strength by sufficiently bringing out the action of the caking ingredient when agglomerating the fine-grained coal to form briquettes and increasing the expansibility of the briquettes at the time of carbonization.

Figure 1:
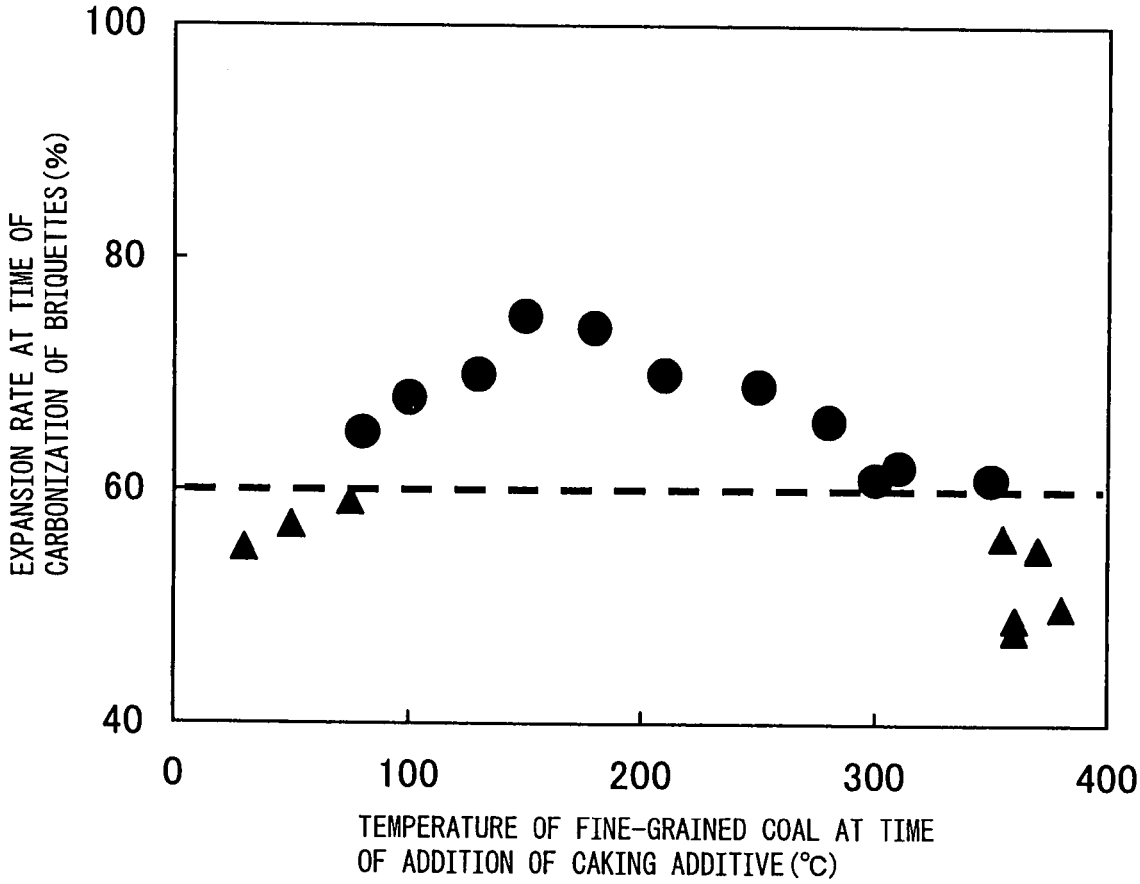
FIG. 1 is a view of the relationship between the temperature at the time of adding the caking additive (tar heavy distillate: content of ingredient with boiling point of 300° C. or more=83.2 mass %) and the expansion rate at the time of carbonization of the briquettes.
Figure 2:
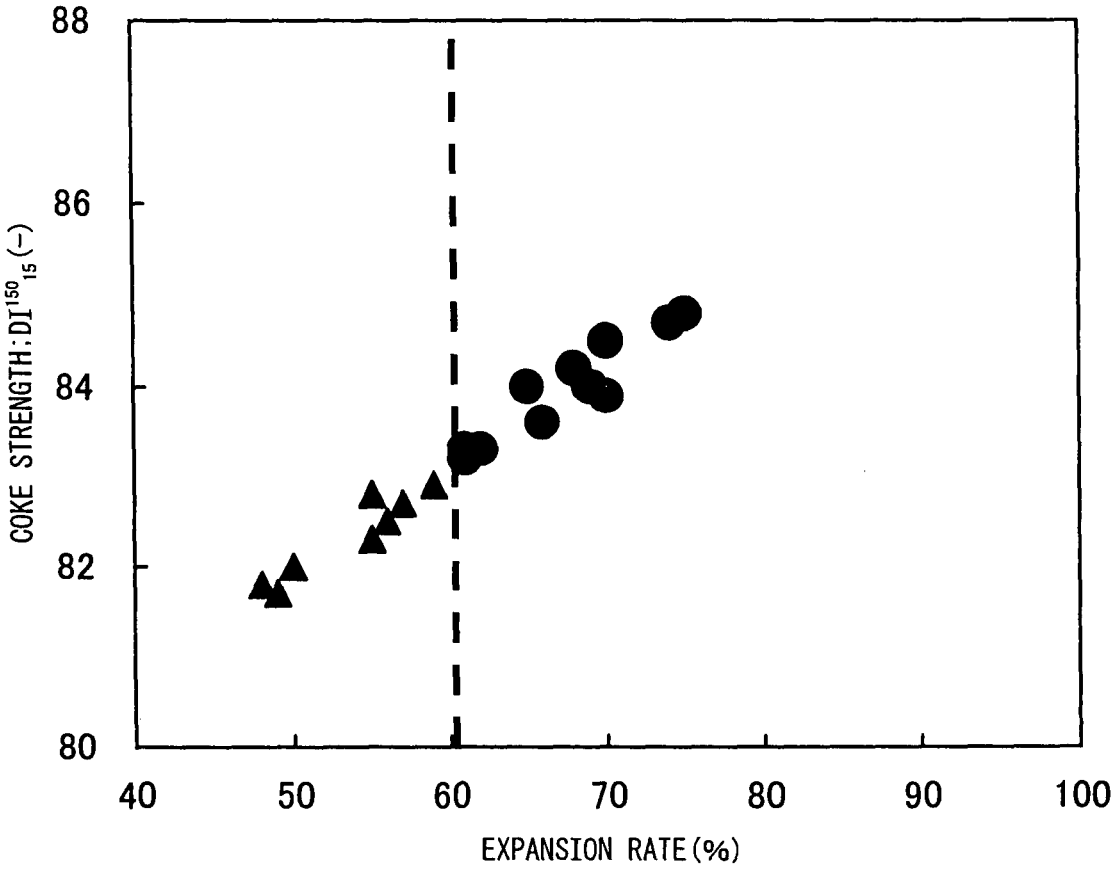
FIG. 2 is a view of the relationship of the expansion rate at the time of carbonization of the briquettes and the coke strength $DI^{150}_{15}$.

As a result, they discovered that by (i) using as the caking additive one or more types of a heavy distillate of tar, soft pitch (residue solid at room temperature obtained by distillation of coal-based tar), and petroleum pitch (residue solid at room temperature obtained by distillation of petroleum-based heavy fuel) and by (ii) adding said caking additive to the fine-grained coal at a predetermined temperature (80 to 350° C.) higher than ordinary temperature and agglomerating the fine-grained coal by hot pressing in the state with the caking additive sufficiently and uniformly permeating and dispersed in the coal, the interaction between the vitrinite and other caking ingredients contained in the fine-grained coal in a high concentration and the caking additive with the high boiling point and softening point results in a remarkable improvement in the expansion rate of the briquettes at the time of carbonization and as a result an exceptional improvement in the coke strength $DI^{150}_{15}$ (see FIG. 1 and FIG. 2).

The heavy distillate of tar, soft pitch, and petroleum pitch caking additives have higher boiling points and softening points compared to normal tar and will not adhere with the vitrinite and other caking ingredients in the fine-grained coal even if added to fine-grained coal at room temperature, but by adding them to the fine-grained coal under high temperature conditions, the caking additives increase in fluidity and uniformly disperse within the fine-grained coal. Further, by agglomerating, they approach the vitrinite and other caking ingredients and are bonded with them by chemical action.

If carbonizing these briquettes by a coke oven, the interaction between the vitrinite or other caking ingredients and the caking additive with the high boiling point and softening point present in a close or bonded state causes an improvement of the caking ability between the coal particles and as a result an improvement of the coke strength.

The present invention was made based on these discoveries and technical ideas and provides a method of production of blast furnace coke characterized by drying mixed coal, then, or simultaneous with the drying, classifying it into fine-grained coal and coarse-grained coal, then adding to the fine-grained coal at a temperature of 80 to 350° C., preferably 120 to 350° C., a caking additive comprised of one or more types of a heavy distillate of tar, soft pitch, and petroleum pitch, agglomerating it by hot pressing, then mixing the clumps of coal and said coarse-grained coal, charging the result in the coke oven, and carbonizing it.

Note that in the present invention, the "caking ability of the coal" is the general name for the properties of the coal observed in the soft molten state when carbonizing it. These properties include the adhesiveness, fluidity, expansibility, etc. (for example, see "Coal Utilization Technical Terminology Dictionary (Fuel Association of Japan ed., 1983), p. 255").

Further, the "expansibility of coal" means the property of coal measured based on the test method described in JIS M 8801. That is, first, the coal is crushed to a particle size of 150 μm (100 mesh) or less, 10% of moisture is added, then the sample is press formed by a predetermined pressure by a molding device to prepare 1/50 tapered masses of a minimum diameter of 6 mm and length of 60±0.25 mm.

Next, this coal sample is inserted into a narrow tube of an inside diameter of 8 mm. A piston is placed on it to apply a load of 150 g, the sample is charged into an electric oven preheated to 300° C., then the sample is heated at a rate of temperature increase of 3° C. per minute and the shrinkage and expansion of the coal sample is measured by displacement of the piston.

The expansibility of coal is found based on the softening start of the coal (when the piston descends 0.5 mm), the temperatures of the maximum shrinkage and maximum expansion, and the shrinkage rate and expansion rate (percents with respect to initial sample length) from the measurement results in the shrinkage and expansion behavior of the coal sample.

The expansion rate of the briquettes in the present invention is the rate measured by the test method described in JIS M 8801. Further, in the present invention, the coke strength $DI^{150}_{15}$ is the strength measured by the drum strength test method described in JIS K 2151 and is shown by the mass ratio of the coke sample remaining on a 15 mm sieve after 150 rotations.

Next, the constitution characterizing the present invention and the reasons for the limitations will be explained.

(Types of Caking Additives)

The present invention uses a caking additive comprised of one or more of a heavy distillate of tar, soft pitch, and petroleum pitch for the following reasons.

Each of these caking additives has a higher boiling point and softening point compared to normal tar and is solid at room temperature, so when mixed with low temperature fine-grained coal and shaped, the caking additive is locally unevenly distributed in the briquettes and sufficient interaction cannot be obtained between the vitrinite or other caking ingredients and the caking additive.

However, when these caking additives are mixed with fine-grained coal of a high temperature of 80 to 350° C. defined in the present invention, the caking additives increase in fluidity and are uniformly dispersed in fine-grained coal. By agglomerating, they bond with the vitrinite or other caking ingredients in the fine-grained coal.

As a result, when carbonizing the obtained briquettes in a coke oven, the interaction between the vitrinite and other caking ingredients in the fine-grained coal and the caking additive with the higher boiling point and softening point compared with normal tar results in an improvement of the expansion rate of the briquettes and enables production of high strength coke.

Normal tar is liquid at room temperature. It has a high fluidity, so it suitable as a caking additive for mixing with low temperature fine-grained coal to obtain pseudo particles, but the effect of improving the expansibility of the briquettes at the time of carbonization is low. The desired coke strength cannot be sufficiently obtained when producing coke using mixed coal with a high ratio of non- or slightly-caking coal or other poor quality coal with poor caking ability.

Due to the above reasons, in the present invention, one or more caking additives with a high boiling point or softening point compared with ordinary tar selected from a heavy distillate of tar, soft pitch (residue solid at room temperature obtained by distillation of coal-based tar), and petroleum pitch (residue solid at room temperature obtained by distillation of petroleum-based heavy oil) is used.

Further, in the present invention, the heavy distillate of tar preferably contains an ingredient having a boiling point at ordinary pressure of 300° C. or more in an amount of 80 mass % (weight %) or more. Further, the main ingredient of the heavy distillate more preferably comprises one or more of phenanthrene, anthracene, methyl naphthalene, and fluoroanthene.

The soft pitch preferably has a softening point between 30 to 200° C.

The petroleum pitch preferably has a hydrogen/carbon atom ratio of 0.9 or more and a softening point between 100 to 400° C.

(Temperature of Fine-Grained Coal at Time of Addition of Caking Additive)

The present invention makes the temperature of the fine-grained coal when adding the caking additive 80 to 350° C. for the following reason. FIG. 1 shows the relationship between the temperature of the fine-grained coal at the time of addition of the caking additive and the expansion rate at the time of carbonization of the briquettes. Further, FIG. 2 shows the relationship between the expansion rate at the time of carbonization of the briquettes and the coke strength $\Delta DI^{150}_{15}$.

Note that FIG. 1 shows the case when using a tar heavy fraction (content of ingredient with boiling point of 300° C. or more=83.2 mass %) as the caking additive. The coke strength $\Delta DI^{150}_{15}$ of the ordinate shows the change of the coke strength $DI^{150}_{15}$ with respect to a reference value DI0 (here, the coke strength $DI^{150}_{15}$=83.0 is used as the reference value DI0, + shows increase from the reference value, and – shows a decrease from the reference value).

The expansion rate of the briquettes shown in FIG. 1 and FIG. 2 is the rate measured by the test method described in the above-mentioned JIS M 8801.

Further, the coke strength $DI^{150}_{15}$ shown in FIG. 2 is the strength measured by drum strength test method described in the above-mentioned JIS K 2151 using a coke sample obtained by carbonization of a mixture of the briquettes and the coarse-grained coal in a test carbonization oven.

Further, the present inventors run similar confirmation tests as with FIG. 1 and FIG. 2 using soft pitch and petroleum pitch as a caking additive other than the above tar heavy fraction and confirmed that similar results were obtained.

In the present invention, as explained above, the caking additive effective for improving the expansibility of the briquettes at the time of carbonization has a high boiling point or softening point, so if the temperature of the fine-grained coal is low when adding and mixing the caking additive, it is not possible to make the caking additive uniformly disperse in the fine-grained coal and not possible to ensure the caking additive is present in the briquettes in a state close to or bonded with the vitrinite or other caking ingredients in the fine-grained coal.

As a result, the effect due to the interaction between the caking additive effective for improving the expansibility of the briquettes at the time of carbonization and the vitrinite or other caking ingredients in the fine-grained coal can no longer be sufficiently obtained.

From FIG. 1 and FIG. 2, the effect of improvement of the expansibility of the briquettes due to the interaction becomes sufficient at a temperature at the time of addition of the caking additive is 80° C. or more, so the lower limit of the temperature at the time of addition of the caking additive was made 80° C.

On the other hand, along with an increase of the temperature at the time of addition of the caking additive, the permeability and dispersibility of the caking additive in the fine-grained coal are promoted, but if the temperature exceeds 350° C., the viscosity of the caking additive rapidly declines, the adhesion is lost, and the action of bonding with the vitrinite or other caking ingredients at the time of dispersion in the fine-grained coal becomes small.

Further, when the temperature at the time of mixing the fine-grained coal and caking additive is high, the caking additive and the caking ingredient in the fine-grained coal are oxidized and the caking ability easily deteriorates.

For these reasons, as shown in FIG. 1 and FIG. 2, when the temperature at the time of addition of the caking additive exceeds 350° C., the effect of improvement of the expansibility at the time of carbonization of the obtained briquettes decreases and the effect of improvement of the coke strength can no longer be sufficiently obtained.

Consequently, in the present invention, the temperature at the time of addition of the caking additive is made 80 to 350°. Further, from the viewpoint of sufficient and uniform permeation and dispersion of the caking additive in the fine-grained coal and promotion of the interaction with the vitrinite and other caking ingredients, preferably the lower limit of the temperature at the time of addition of the caking additive is made more than 120° C.

Note that, the present invention dries the mixed coal by a dryer, then, or simultaneously with the drying, classifies the coal into fine-grained coal and coarse-grained coal, transports the fine-grained coal to a molding machine, adds and mixes a caking additive to the fine-grained coal at the entry side of the molding machine, then charges the mixture into the molding machine for agglomerating.

The temperature of the fine-grained coal at the outlet of the dryer is 100° C. or more, but the fine-grained coal is cooled in the process of transport to the inlet side of the molding machine. In the present invention, to obtain the effect of improvement of the coke strength by the modifying action of the fine-grained coal, it is not necessary to define the temperature of the fine-grained coal at the outlet side of the dryer. It is possible to improve the coke strength by defining the temperature of the fine-grained coal at the time of addition of the caking additive as the above range.

Therefore, when the temperature of the fine-grained coal at the outlet side of the dryer becomes low, it is possible to use a temperature holding device or heating device to adjust the temperature of the fine-grained coal at the time of addition of the caking additive to the above range in the process of transport to the outlet of the dryer.

The present invention, as explained above, can sufficiently obtain the effect aimed at by the present invention by defining the type of the caking additive and the temperature of the fine-grained coal at the time of addition of the caking additive, but to obtain a stabler effect and higher effect, it is more preferable to define the amount of addition of the caking additive, the linear pressure at the time of agglomerating by hot pressing, the amount of inclusion of the non- or slightly-caking coal, and the particle size of the fine-grained coal as follows:

(Amount of Addition of Caking Additive)

The amount of addition of the caking additive for mixing with the fine-grained coal is preferably 2 to 20 mass % (weight %) for the following reasons.

If the amount of addition of the caking additive is less than 2 mass %, the effect due to the interaction between the caking additive effective for improving the expansibility of the briquettes at the time of carbonization and the vitrinite or other caking ingredient in the fine-grained coal can no longer be stably obtained.

On the other hand, when the amount of addition of the caking additive is over 20 mass %, the amount of addition of the caking additive per briquette increases, so the charging density when charging the coke oven falls and the effect of improvement of the coke strength can no longer be obtained, so this is not preferable.

Further, the caking additive is not preferably added in excess since it becomes a cause of formation of carbon sticking to the walls of the coke oven.

For these reasons, to stably achieve the desired coke strength, the amount of addition of the caking additive comprised of the one or more types of a heavy distillate of tar, soft pitch, and petroleum pitch is preferably made 2 to 20 mass %.

(Linear Pressure at Time of Agglomerating by Hot Pressing)

For the following reasons, the pressure when hot pressing the mixture of the fine-grained coal and caking additive is preferably made a linear pressure of 0.5 to 10 t/cm.

When the linear pressure at the time of agglomerating by hot pressing is less than 0.5 t/cm, it is difficult to reduce the distance between the fine-grained particles and stably achieve closeness or bonding of the caking additive and the vitrinite or other caking ingredient in the fine powder due to the agglomerating and the effect of improvement of the expansion rate of the briquettes due to the interaction between the caking additive and caking ingredient at the time of carbonization can no longer be stably obtained.

On the other hand, when the linear pressure at the time of agglomerating by hot pressing exceeds 10 t/cm, the fine-grained coal is shaped by excessive pressure and therefore the obtained briquettes crack and the briquette yield falls, so this is not preferable.

For these reasons, to stably obtain the desired coke strength, the pressure at the time of hot pressing the mixture of the fine-grained coal and the caking additive is preferably a linear pressure of 0.5 to 10 t/cm.

Note that in the present invention, the "linear pressure at the time of hot pressing" means the pressing force (t/cm) per unit roll width in the roll axial direction when using a agglomerating roll.

(Amount of Non- or Slightly-Caking Coal)

In the present invention, the lower limit of the mixed amount of the non- or slightly-caking coal in the mixed coal does not have to be set. Even if using caking coal or other coal with a high caking ability, the action of the vitrinite or other caking ingredient contained in large amounts in the fine-grained cal after crushing the coal is not degraded and coke of a higher strength than the past can be obtained by the interaction with the caking additive at the time of carbonization.

However, as explained above, from the viewpoint of the stable supply of the raw material resources and the reduction of the production costs, it is preferable to mix into the mixed carbon a large amount of non- or slightly-caking coal, which has a lower caking ability than caking coal but is inexpensive, and secure the coke strength required for a blast furnace material.

In the present invention, to obtain the effect of improvement of the expansion rate of the briquettes at the time of carbonization due to the interaction between the caking additive in the briquettes and the vitrinite or other caking ingredients, it is possible to secure the coke strength required for a blast furnace material even if mixing in a larger amount of non- or slightly-caking coal into the mixed coal compared with the past.

However, if the mixed amount of the non- or slightly-caking coal in the mixed coal is over 70 mass %, even if using the present invention, it is not longer possible to stably secure the coke strength required in a blast furnace material due to the drop in caking ability due to the increase in non- or slightly-caking coal, so the upper limit of the mixed amount of the non- or slightly-caking coal is preferably made 70 mass %.

Consequently, in the present invention, it is preferable that the mixed amount of non- or slightly-caking coal is 0 to 70 mass % (weight %). Note that from the viewpoint of securing the coke strength and reducing the production cost of coke, the mixed amount of the non- or slightly-caking coal is preferably 40 to 70 mass % (weight %).

(Particle Size of Fine-Grained Coal)

As explained above, the vitrinite or other caking ingredient in the coal is softer than the inert ingredients and other non-softening ingredients. When crushing the coal, it easily separates, so becomes more concentrated in the fine-grained coal. Therefore, it is present in a large amount in the fine-grained coal of the particle size of 0.5 mm or less after crushing the coal.

However, the particle size after crushing the coal becomes smaller and the fine-grained coal becomes easily oxidized compared with the coarse grains in the high temperature state after drying and classification of the coal, so the vitrinite or other caking ingredient in the fine-grained coal also easily deteriorates in caking ability due to oxidation. Further, the fine-grained coal of the particle size of 0.5 mm or less after drying the coal becomes the cause of dust production.

In the present invention, by adding the above caking additive to the fine-grained coal causing dust production after crushing coal and agglomerating the mixture by hot pressing, it is possible to suppress the dust production due to the fine-grained coal, suppress the oxidation of the vitrinite and other caking ingredients, and improve the coke strength by the effect of improvement of the expansion rate of the briquettes at the time of carbonization due to the interaction between the caking additive and the caking ingredients.

The concentration of the vitrinite or other caking ingredient contained in the fine-grained carbon after crushing the coal becomes higher the smaller the particle size of the fine-grained carbon, but the drop in the caking ability due to the oxidation in the high temperature state becomes remarkable. Therefore, in the present invention, to stably achieve the desired coke strength, the particle size of the fine-grained carbon after drying and classifying the coal preferably becomes 0.5 mm or more.

(Rapid Heating Conditions of Coarse-Grained Coal)

The present invention dries and classifies the mixed coal, then mixes the fine-grained coal with the caking additive under the above conditions, hot presses the mixture, then charges it together with the coarse-grained coal of the balance of the mixed coal into the coke oven for carbonization.

At this time, even if the coarse-grained coal is carbonized as it is in the coke oven after drying and classifying the mixed coal, the strength of the obtained coke is improved compared with the past due to the effect of improvement of the expansion rate at the time of carbonization of the briquettes according to the present invention.

However, when mixing a large amount of non- or slightly-caking coal with a low caking ability in the mixed coal or desiring to improve the coke strength more, the coarse-grained coke mixed with the briquettes and charged into the coke oven is preferably rapidly heated by a rate of temperature increase of 100 to 10,000° C./second to a peak temperature of 300 to 450° C. before mixing.

In the rapid heating of the coarse-grained coal, when the peak temperature is less than 300° C., the effect of improvement of the coke strength due to the improvement of the caking ability of the coarse-grained coal becomes lower.

However, in the present invention, as explained above, a large improvement in the expansion rate is obtained due to the synergistic action between the vitrinite ingredient in the fine-grained carbon and the caking additive, so even if the peak temperature in the rapid heating of the above coarse-grained carbon is less than 300° C., the coke strength can be sufficient improved.

Further, by agglomerating the fine-grained coal by a high temperature, then raising the temperature of the briquettes, the diffusion of the caking additive in the briquettes becomes excellent, so the expansion rate due to the chemical action between the vitrinite ingredient and caking additive can be improved more. Aiming at this effect, it is also possible to rapidly heat the coarse-grained carbon under conditions of a peak temperature of less than 300° C., then mix it with the briquettes comprised of the fine-grained coal.

Due to this, when carbonizing the coal by a coke oven, in addition to the effect of the briquettes, an effect of improvement of the caking ability of the coarse-grained coal is obtained. Even if mixing in a large amount of non- or slightly-caking coal, the coke strength can be improved more.

EXAMPLE

Below, examples will be used to explain the effects of the present invention.

Note that the present invention is not limited to the following invention examples so long as the object and technical idea of the present invention are not deviated from.

Example

Figure 4:
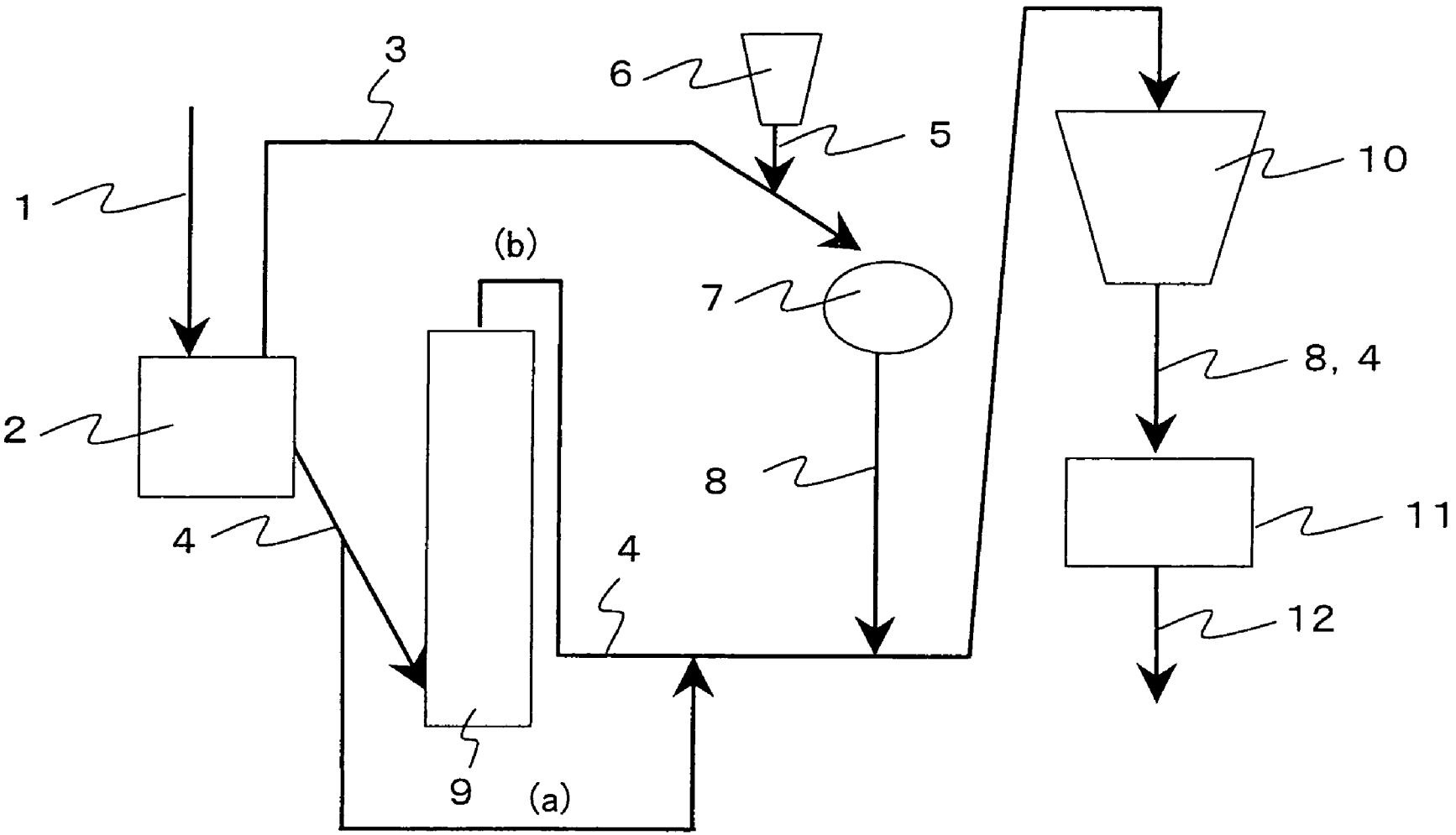
FIG. 4 is a view of the coke production process.

FIG. 4 shows a process of production of coke used in the present examples.

Mixed coal 1 is heated and dried at 80 to 220° C. by a fluid bed dry classifier 2 and classified into fine-grained coal 3 of a particle size of 0.5 mm or less and coarse-grained coal 4 of a particle size of over 0.5 mm.

Samples of the fine-grained coal 3 of a particle size of 0.5 mm or less were press formed using a double roll type molding machine 7 to produce briquettes 8 using caking additives 5 comprised of a tar heavy distillate and ordinary tar having the ingredients and boiling point shown in Table 2 and soft pitch and petroleum pitch having the softening points and hydrogen/carbon atom ratios shown in Table 3 added to the fine-grained coal 3 under the conditions shown in Table 1 in predetermined amounts from a caking additive storage tank 6.

Part of the coarse-grained coal 4 of a particle size of over 0.5 mm heated, dried, and classified by the above fluid bed dry classifier 2 was mixed as is without rapid heat treatment (see route (a) in FIG. 4), then charged from the coal tank 10 to a test carbonization oven 11 of a width of 450 mm to produce coke 12.

Further, part of the coarse-grained coal 4 of a particle size of over 0.5 mm heated, dried, and classified by the above fluid bed dry classifier 2 was rapidly heated using an air flow tower type heater 9 at a rate of temperature increase of 3000° C./second to a peak temperature of 350° C. (see route (b) in FIG. 4), then was mixed with the briquettes 8 comprised of the fine-grained coal and charged from the coal tank 10 to a test carbonization oven 11 of a width of 450 mm to produce coke 12.

In the test carbonization oven, 90 kg of a mixture of the briquettes and the coarse-grained coal was carbonized under conditions of a heating temperature of 1200° C. and a carbonization time of 14 hours to produce coke. The expansibility of the briquettes 8 and the strength of the obtained coke 12 were measured.

Table 1 shows the production conditions and test results. Further, FIG. 3 shows the relationship between the expansion rate of the briquettes and the coke strength $DI^{150}_{15}$ in the invention examples (Example Nos. 1 to 16) and comparative examples (Example Nos. 17 to 26).

Figure 3:
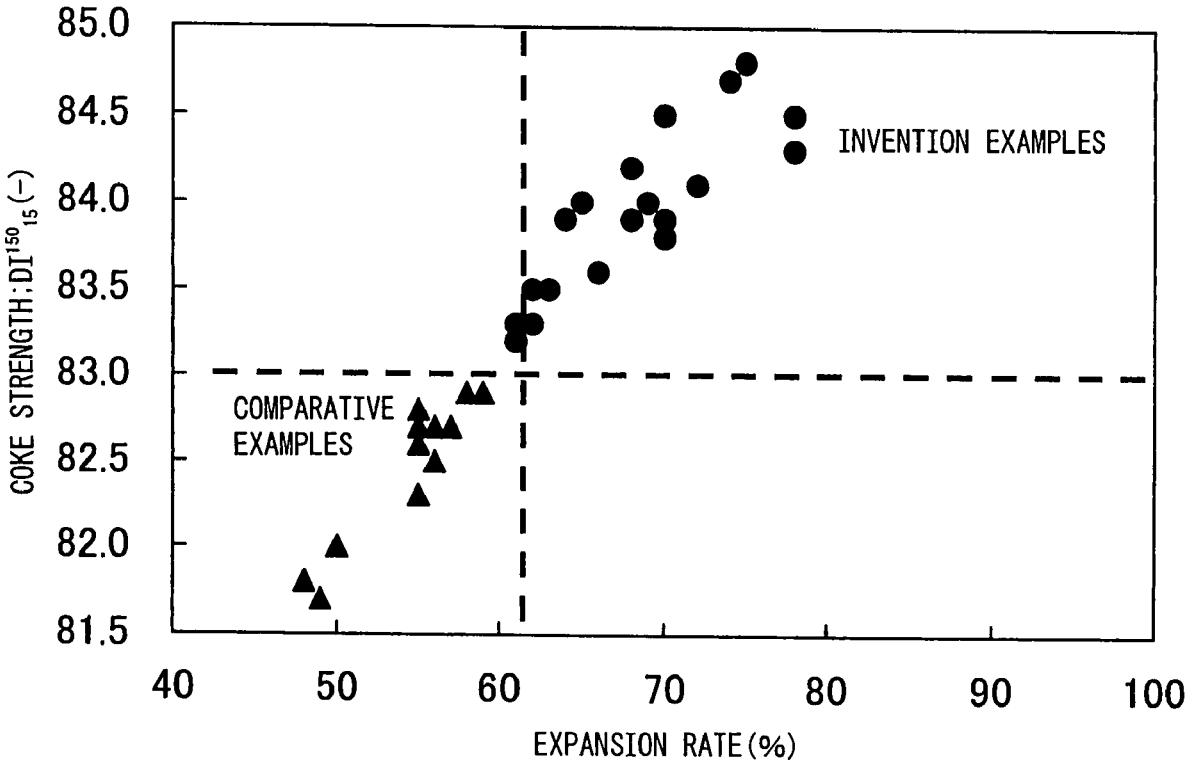
FIG. 3 is a view of the relationship of the expansion rate at the time of carbonization of the briquettes of the invention examples and comparative examples and the coke strength $DI^{150}_{15}$.

Note that the expansion rates of the briquettes shown in Table 1 and FIG. 3 are measured in accordance with the test method described in JIS M 8801. Further, the coke strength $DI^{150}{}_{15}$ is measured according to the drum strength test method described in JIS K 2151.

The invention examples of Example No. 1 to 26 shown in Table 1 have types of caking additives and temperatures of the fine-grained coal at the time of addition of caking additives satisfying the ranges prescribed by the present invention. The expansibility at the time of carbonization of the briquettes is a high 60% or more. Coke superior in strength with a targeted $DI^{150}{}_{15}$ of 83.0 or more is obtained.

Note that the invention examples of Example Nos. 1 to 7 shown in Table 1 are invention examples in the case of not rapidly heat treating the coarse-grained coal, while the invention examples of Example Nos. 8 to 26 are invention examples in the case of rapidly heat treating the coarse-grained coal.

As opposed to this, the comparative examples of Example Nos. 27 to 39 have types of caking additives and temperatures of the fine-grained coal at the time of addition of caking additives outside the ranges prescribed by the present invention, so the expansibility at the time of carbonization of the briquettes did not reach 60% and the targeted $DI^{150}{}_{15}$ of 83.0 could not be obtained.

TABLE 1

| | Ex. No. | Temp. of addition of caking additive (° C.) | Type of caking additive | Amount of addition of caking additive (mass %) | Agglomerating temp. (° C.) | Agglomerating linear press. (t/cm) | Expansibility at time of carbonization (%) | Coke strength; $DI^{150}{}_{15}$ | Class |
|---|---|---|---|---|---|---|---|---|---|
| Without rapid heat treatment | 1 | 80 | Modified tar | 10 | 80 | 5 | 65 | 83.3 | Inv. ex. |
| | 2 | 150 | Modified tar | 8 | 150 | 5 | 75 | 83.9 | Inv. ex. |
| | 3 | 180 | Modified tar | 8 | 180 | 5 | 74 | 84.0 | Inv. ex. |
| | 4 | 210 | Modified tar | 8 | 160 | 5 | 70 | 83.5 | Inv. ex. |
| | 5 | 250 | Petro. pitch | 10 | 180 | 5 | 69 | 83.6 | Inv. ex. |
| | 6 | 280 | Modified tar | 8 | 190 | 5 | 66 | 83.5 | Inv. ex. |
| | 7 | 350 | Petro. pitch | 10 | 210 | 5 | 61 | 83.3 | Inv. ex. |
| With rapid heat treatment | 8 | 80 | Modified tar | 8 | 80 | 5 | 65 | 84.0 | Inv. ex. |
| | 9 | 100 | Modified tar | 8 | 100 | 5 | 68 | 84.2 | Inv. ex. |
| | 10 | 130 | Modified tar | 8 | 130 | 5 | 70 | 84.5 | Inv. ex. |
| | 11 | 150 | Modified tar | 8 | 150 | 5 | 75 | 84.8 | Inv. ex. |
| | 12 | 180 | Modified tar | 8 | 180 | 5 | 74 | 84.7 | Inv. ex. |
| | 13 | 150 | Modified tar | 3 | 150 | 5 | 72 | 84.1 | Inv. ex. |
| | 14 | 150 | Modified tar | 15 | 150 | 5 | 78 | 84.5 | Inv. ex. |
| | 15 | 150 | Modified tar | 1 | 150 | 5 | 62 | 83.5 | Inv. ex. |
| | 16 | 150 | Modified tar | 20 | 150 | 5 | 78 | 84.3 | Inv. ex. |
| | 17 | 150 | Modified tar | 8 | 150 | 0.2 | 70 | 83.8 | Inv. ex. |
| | 18 | 150 | Modified tar | 8 | 150 | 11 | 68 | 83.9 | Inv. ex. |
| | 19 | 150 | Soft pitch | 8 | 150 | 5 | 64 | 83.9 | Inv. ex. |
| | 20 | 150 | Petro. pitch | 8 | 150 | 5 | 63 | 83.5 | Inv. ex. |
| | 21 | 210 | Modified tar | 8 | 160 | 5 | 70 | 83.9 | Inv. ex. |
| | 22 | 250 | Petro. pitch | 9 | 180 | 5 | 69 | 84.0 | Inv. ex. |
| | 23 | 280 | Modified tar | 8 | 190 | 5 | 66 | 83.6 | Inv. ex. |
| | 24 | 300 | Modified tar | 8 | 200 | 5 | 61 | 83.3 | Inv. ex. |
| | 25 | 310 | Soft pitch | 8 | 205 | 5 | 62 | 83.3 | Inv. ex. |
| | 26 | 350 | Petro. pitch | 8 | 210 | 5 | 61 | 83.2 | Inv. ex. |
| With rapid heat treatment | 27 | 30 | Ord. tar | 8 | 30 | 5 | 55 | 82.6 | Comp. ex. |
| | 28 | 100 | Ord. tar | 8 | 100 | 5 | 56 | 82.7 | Comp. ex. |
| | 29 | 150 | Ord. tar | 8 | 150 | 5 | 55 | 82.7 | Comp. ex. |
| | 30 | 30 | Modified tar | 8 | 30 | 5 | 55 | 82.8 | Comp. ex. |
| | 31 | 75 | Modified tar | 8 | 75 | 5 | 59 | 82.9 | Comp. ex. |
| | 32 | 75 | Soft pitch | 8 | 75 | 5 | 58 | 82.9 | Comp. ex. |
| | 33 | 75 | Petro. pitch | 8 | 75 | 5 | 55 | 82.8 | Comp. ex. |
| | 34 | 360 | Modified tar | 8 | 220 | 5 | 48 | 81.8 | Comp. ex. |
| | 35 | 360 | Soft pitch | 8 | 220 | 5 | 49 | 81.7 | Comp. ex. |
| | 36 | 380 | Petro. pitch | 8 | 227 | 5 | 50 | 82.0 | Comp. ex. |
| | 37 | 50 | Modified tar | 8 | 50 | 5 | 57 | 82.7 | Comp. ex. |
| | 38 | 365 | Modified tar | 8 | 220 | 5 | 56 | 82.5 | Comp. ex. |
| | 39 | 370 | Modified tar | 8 | 227 | 5 | 55 | 82.3 | Comp. ex. |

TABLE 2

| | Naphthalene | | Phenanthrene | | Anthracene | | Methyl naphthalene | | Fluoroanthene | | Other | Boiling point: 300° C. |
|---|---|---|---|---|---|---|---|---|---|---|---|---|
| | Content (mass %) | Boiling point (° C.) | Content (mass %) | Boiling point (° C.) | Content (mass %) | Boiling point (° C.) | Content (mass %) | Boiling point (° C.) | Content (mass %) | Boiling point (° C.) | component Content (mass %) | or more, total content of ingredients %) |
| Tar heavy distillate | 1.5 | 218 | 6.4 | 338 | 2.5 | 341 | 2.8 | 359 | 3.9 | 383 | 82.9 | 83.2 |

TABLE 2-continued

| | Naphthalene | | Phenanthrene | | Anthracene | | Methyl naphthalene | | Fluoroanthene | | Other | Boiling point: 300° C. |
|---|---|---|---|---|---|---|---|---|---|---|---|---|
| | Content (mass %) | Boiling point (° C.) | Content (mass %) | Boiling point (° C.) | Content (mass %) | Boiling point (° C.) | Content (mass %) | Boiling point (° C.) | Content (mass %) | Boiling point (° C.) | component Content (mass %) | or more, total content of ingredients %) |
| Ordinary tar | 12.4 | 218 | 5.1 | 338 | 1.9 | 341 | 2.2 | 359 | 3.1 | 383 | 75.3 | 70.9 |

TABLE 3

| | Softening point (° C.) | Hydrogen/carbon ratio |
|---|---|---|
| Soft pitch | 58 | 0.644 |
| Petroleum pitch | 140 | 0.995 |

INDUSTRIAL APPLICABILITY

As explained in detail above, according to the present invention, even if using mixed coal containing a large amount of inexpensive non- or slightly-caking coal or other poor quality coal with a low caking ability, it is possible to obtain briquettes with a high expansion rate at the time of carbonization. By carbonizing this briquettes in a coke oven, it is possible to produce high strength coke inexpensively with a high productivity. Consequently, the present invention has great utilizability in the coke production industry.

The invention claimed is:

1. A method of production of blast furnace coke characterized by drying mixed coal, then, or simultaneously with the drying, classifying it into fine-grained coal and coarse-grained coal, then adding to the fine-grained coal at a temperature of 80 to 350° C. a caking additive comprised of one or more of a heavy distillate of tar, soft pitch, and petroleum pitch, agglomerating it by hot pressing to form clumps of coal, then mixing the clumps of coal and the coarse-grained coal and charging and carbonizing the mixture in a coke oven.

2. A method of production of blast furnace coke as set forth in claim 1 characterized by adding the caking additive to fine-grained coal at a temperature of over 120° C. to 350° C. and agglomerating it by hot pressing.

3. A method of production of blast furnace coke as set forth in claim 1 characterized in that said heavy distillate of tar contains an ingredient with a boiling point at ordinary pressure of 300° C. or more in an amount of 80 weight % or more.

4. A method of production of blast furnace coke as set forth in claim 1 characterized in that said heavy distillate is mainly comprised of one or more of phenanthrene, anthracene, methyl naphthalene, and fluoroanthene.

5. A method of production of blast furnace coke as set forth in claim 1 characterized in that said soft pitch has a softening point of 30 to 200° C.

6. A method of production of blast furnace coke as set forth in claim 1 characterized in that said petroleum pitch has a hydrogen/carbon atomic ratio of 0.9 or more and a softening point of 100 to 400° C.

7. A method of production of blast furnace coke as set forth in claim 1 characterized in that the amount of addition of said caking additive is 2 to 20 weight %.

8. A method of production of blast furnace coke as set forth in claim 1 characterized by agglomerating by hot pressing at a linear pressure of 0.5 to 10 t/cm.

9. A method of production of blast furnace coke as set forth in claim 1 characterized in that said mixed coal is comprised of non- or slightly-caking coal in an amount of 0 to 70 weight % and the balance of caking coal.

10. A method of production of blast furnace coke as set forth in claim 1 characterized by classifying the coal to fine-grain of 0.5 mm or less and coarse-grained coal of over 0.5 mm.

11. A method of production of blast furnace coke as set forth in claim 1 characterized by classifying the coal to fine-grained coal and coarse-grained coal, then rapid heating the coarse-grained coal at a rate of temperature increase of 100 to 10,000° C./second to a peak temperature of 300 to 450° C., then charging and carbonizing said coarse-grained coal and said clumps of coal in a coke oven.

* * * * *